US011353903B1

(12) United States Patent
Coban

(10) Patent No.: US 11,353,903 B1
(45) Date of Patent: Jun. 7, 2022

(54) VOLTAGE REFERENCE CIRCUIT

(71) Applicant: Silicon Laboratories Inc., Austin, TX (US)

(72) Inventor: Abdulkerim L Coban, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 0 days.

(21) Appl. No.: 17/219,225

(22) Filed: Mar. 31, 2021

(51) Int. Cl.

| | |
|---|---|
| ***G05F 1/567*** | (2006.01) |
| ***G05F 3/26*** | (2006.01) |
| ***G05F 1/445*** | (2006.01) |
| ***G05F 1/46*** | (2006.01) |

(52) U.S. Cl.
CPC ..... *G05F 1/567* (2013.01); *G05F 1/445* (2013.01); *G05F 1/468* (2013.01); *G05F 3/262* (2013.01)

(58) Field of Classification Search
CPC ..... G05F 3/02; G05F 3/08–10; G05F 3/16; G05F 3/20; G05F 3/22–30
See application file for complete search history.

(56) References Cited

U.S. PATENT DOCUMENTS 4,300,091 A * 11/1981 Schade, Jr. ..... G05F 3/265 323/315
4,327,321 A * 4/1982 Suzuki ..... G05F 3/262 323/315
5,373,226 A * 12/1994 Kimura ..... G05F 3/245 323/313
5,512,855 A * 4/1996 Kimura ..... G01K 7/01 323/312
5,627,461 A * 5/1997 Kimura ..... G05F 3/30 323/312
6,160,393 A * 12/2000 Ahn ..... G05F 3/262 323/315
6,528,979 B2 * 3/2003 Kimura ..... G05F 3/267 323/313
6,844,772 B2 * 1/2005 Hoon ..... G05F 3/262 323/315

(Continued)

OTHER PUBLICATIONS

Kerns, Jr., David. "Optimization of the Peaking Current Source" *IEEE J. Solid-State Circuits*. vol. SC-21, No. 4. pp. 587-590. Aug. 1986.

(Continued)

*Primary Examiner* — Thomas J. Hiltunen
(74) *Attorney, Agent, or Firm* — Gary Stanford; Huffman Law Group, PC

(57) ABSTRACT

A voltage reference circuit that can operate in a large supply voltage range with high PSRR, that dissipates low-power for a given output noise, and that has a low temperature-coefficient (TC) across a wide-temperature range. The voltage reference circuit does not require any calibration for low TC and high PSRR, occupies a relatively small circuit area, may be used without additional supply filtering in noisy or high-ripple supply environments, and is more robust against device mismatch effects particularly compared to designs based on sub-threshold operations. The voltage reference circuit is a special form of constant transconductance circuit that uses current mirror ratios that are chosen to achieve high PSSR and low noise properties. The device saturation voltage may be chosen so that flat temperature characteristics may be achieved.

20 Claims, 11 Drawing Sheets

$$g_{mI} R \simeq \alpha\left(1 - \frac{1}{(MN)^{1/\alpha}}\right)$$ 120

CHOOSE $MN \simeq \left(\frac{\alpha}{\alpha - 1}\right)^{\alpha}$ so that $g_{mI} R \simeq 1$ 122

(56) References Cited

U.S. PATENT DOCUMENTS

| | | | | |
|---|---|---|---|---|
| 7,429,854 | B2 * | 9/2008 | Kimura | G05F 3/262 323/315 |
| 7,619,402 | B1 * | 11/2009 | Kwong | G05F 1/575 323/297 |
| 8,013,588 | B2 * | 9/2011 | Imura | G05F 3/242 323/313 |
| 8,476,967 | B2 * | 7/2013 | Kobayashi | G05F 3/242 327/543 |
| 2018/0307262 | A1 * | 10/2018 | Feng | H03K 17/0822 |

OTHER PUBLICATIONS

Xiaobin, Ye et al. "Low Voltage Self-Biasing Reference Circuits." *IEEE Proc. ASICON 2001*. pp. 314-317. Oct. 2001.

Cheng, M.-H. et al. "Low-power low-voltage reference using peaking current mirror circuit." *IEE Electronics Letters*. vol. 41, No. 10. pp. 1-2. May 2005.

Jiang, Jize et al. "5.6ppm/° C. Temperature Coefficient, 87-dB PSRR, Sub-1-V voltage reference in 65-nm CMOS exploiting the zero-temperature-coefficient point." *IEEE J. Solid-State Circuits*. vol. 52, No. 3, pp. 623-633. Mar. 2017.

* cited by examiner

120

$$g_{m1} R = \alpha\left(1 - \frac{1}{(MN)^{1/\alpha}}\right)$$

122

$$\text{CHOOSE} \quad MN = \left(\frac{\alpha}{\alpha - 1}\right)^{\alpha} \text{ so that } g_{m1} R = 1$$

120

$$g_{m1} R = \alpha\left(1 - \frac{1}{(MN)^{1/\alpha}}\right)$$

122

CHOOSE $MN = \left(\frac{\alpha}{\alpha - 1}\right)^{\alpha}$ so that $g_{m1} R = 1$

120

$$g_{m1} R = \alpha\left(1 - \frac{1}{(MN)^{1/\alpha}}\right)$$

122

CHOOSE $MN = \left(\frac{\alpha}{\alpha - 1}\right)^{\alpha}$ so that $g_{m1} R = 1$

VOLTAGE REFERENCE CIRCUIT

BACKGROUND OF THE INVENTION

Field of the Invention

The present invention relates in general to voltage references, and more particularly to a low noise, high power supply rejection ratio (PSRR) voltage reference with temperature compensation.

Description of the Related Art

Voltage reference circuits are used to provide a reference voltage that may be used for many analog or digital circuits including radio frequency (RF) circuits and the like. It is desired that the reference voltage remain relatively stable or fixed regardless of circuit variations or operating conditions. For example, it may be desired that the voltage reference circuit exhibit a relatively high power supply rejection ratio (PSRR) in which the reference voltage stays substantially unmodified in spite of changes of power supply voltages. It may also be desired that the reference voltage remain substantially unmodified regardless of temperature changes within a relatively wide temperature range. It may further be desired that the reference voltage remain substantially unmodified in spite of variations from one circuit to the next. Many conventional voltage reference circuits are known, but often consume significant circuit area or consume a significant amount of power for a given supply rejection and noise budget.

SUMMARY OF THE INVENTION

A voltage reference system according to one embodiment includes a voltage reference circuit. The voltage reference circuit includes first and second transistors of a first conductivity type, first and second transistors of a second conductivity type, and a resistive device. The first transistor of the first conductivity type has first and second current terminals coupled between a first supply voltage node and an output node providing a reference voltage, and has a control terminal coupled to a first node. The second transistor of the first conductivity type has first and second current terminals coupled between the first supply voltage node and a second node and has a control terminal coupled to the output node. The first transistor of the second conductivity type has first and second current terminals coupled between a second supply voltage node and the first node, and has a control terminal coupled to the second node. The second transistor of the second conductivity type has first and second current terminals coupled between the second supply voltage node and the second node, and has a control terminal coupled to the second node. The resistive device is coupled between the first node and the output node. The first and second transistors of the first conductivity type are governed by an $\alpha$-power-law relationship having a power factor $\alpha$, in which a size ratio of the first and second transistors of the first conductivity type is 1:N, in which a size ratio of the first and second transistors of the second conductivity type is M:1, and in which M and N are selected such that a multiple of M times N is equal to $(\alpha/(\alpha-1))^{\alpha}$.

The voltage reference circuit exhibits a relatively high power supply rejection ratio (PSRR) in which the reference voltage stays substantially unmodified in spite of changes of power supply voltages on the first and second supply voltage nodes. The reference voltage also remains substantially unmodified regardless of temperature changes within a relatively wide temperature range. In a more specific case, the first and second transistors of the first conductivity type may be governed by a square-law relationship when the power factor $\alpha$ is equal to 2, so that M and N are selected so that the multiple of M times N is equal to 4. Given gm is a transconductance of the first transistor of the first conductivity type and R is a resistance of the resistive device, then gm multiplied by R is equal to $\alpha(1-1/(M/N)^{1/\alpha})$.

In one embodiment, the first supply voltage node develops a lower supply voltage, the second supply voltage node develops an upper supply voltage, the first conductivity type is N-type, and the second conductivity type is P-type. In this case the reference voltage is referenced to a supply reference voltage developed on the first supply voltage node. In another embodiment, the first supply voltage node develops an upper supply voltage, the second supply voltage node develops a lower supply voltage, the first conductivity type is P-type and the second conductivity type is N-type. In this case the reference voltage is referenced to an upper supply voltage developed on the first supply voltage node.

The voltage reference system may be implemented as a voltage regulator, further including an operational amplifier having a first input receiving the reference voltage, having a second input coupled to a junction node, and having an output, a third transistor of the second conductivity type having current terminals coupled between the second supply voltage node and a regulated node developing a regulated voltage and having a control input coupled to the output of the operational amplifier, a junction resistor having a first terminal coupled to the regulated node and having a second terminal coupled to the junction node, and an adjustable resistor coupled between the junction node and the first supply voltage node, in which a resistance of the adjustable resistor is adjusted to set a voltage level of the regulated voltage.

The voltage reference circuit of the voltage reference system may include one or more additional reference branches. In one embodiment, the voltage reference system further includes a third transistor of the first conductivity type having first and second current terminals coupled between a third supply voltage node and a second output node which provides a second reference voltage and having a control terminal coupled to a third node, a third transistor of the second conductivity type having first and second current terminals coupled between the second supply voltage node and the third node and having a control terminal coupled to the second node, and a second resistive device coupled between the third node and the second output node. The voltage level of the second reference voltage is determined by a factor K, in which a size ratio of the third and second transistors of the second conductivity type is KM:1, in which a size ratio of the third and first transistors of the first conductivity type is K:1, in which a resistance of the first resistive device is R, and in which a resistance of the second resistive device is R/K. The third supply voltage node may be an extension of the first supply voltage node or may be an independent supply voltage reference node.

The voltage reference system may include one or more additional transistors to develop a current that is proportional to absolute temperature. In one embodiment, the voltage reference system further includes a third transistor of the first conductivity type having first and second current terminals coupled between the first supply voltage node and a third node and having a control terminal coupled to the output node, in which the third transistor develops a current that is proportional to absolute temperature. Depending upon the conductivity type, the third transistor may sink or source the current that is proportional to absolute temperature. In another embodiment, the voltage reference system further includes a third transistor of the second conductivity type having first and second current terminals coupled between the second supply voltage node and a third node and having a control terminal coupled to the second node, in which the third transistor develops a current that is proportional to absolute temperature. Again depending upon the conductivity type, the third transistor may sink or source the current that is proportional to absolute temperature.

A voltage reference circuit according to another embodiment may include an operational amplifier and a second resistive device. In one embodiment, the control and current terminals of the second transistor of the second conductivity type are disconnected. The inputs of the operational amplifier are coupled to the current terminals of the first and second transistors of the first conductivity type, and the output of the operational amplifier is coupled to the control terminals of the transistors of the second conductivity type. The second resistive device is coupled between the current terminals of the second transistor of the first conductivity type and the second transistor of the second conductivity type, and has a resistance equal to the factor M times the resistance of the first resistive device. The control terminal of the second transistor of the first conductivity type is coupled to its current terminal that is also coupled to the second resistive device.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

A voltage reference circuit as described herein can operate in a large supply voltage range with high PSRR, dissipates low-power for a given output noise, and has a low temperature-coefficient (TC) across a wide-temperature range. The voltage reference circuit does not require any calibration for low TC and high PSRR, occupies a relatively small circuit area, may be used without additional supply filtering in noisy or high-ripple supply environments, and is more robust against device mismatch effects particularly compared to designs based on sub-threshold operations. The voltage reference circuit is a special form of constant transconductance circuit that uses current mirror ratios that are chosen to achieve high PSSR and low noise properties. The device saturation voltage may be chosen so that flat temperature characteristics may be achieved.

Figure 1:
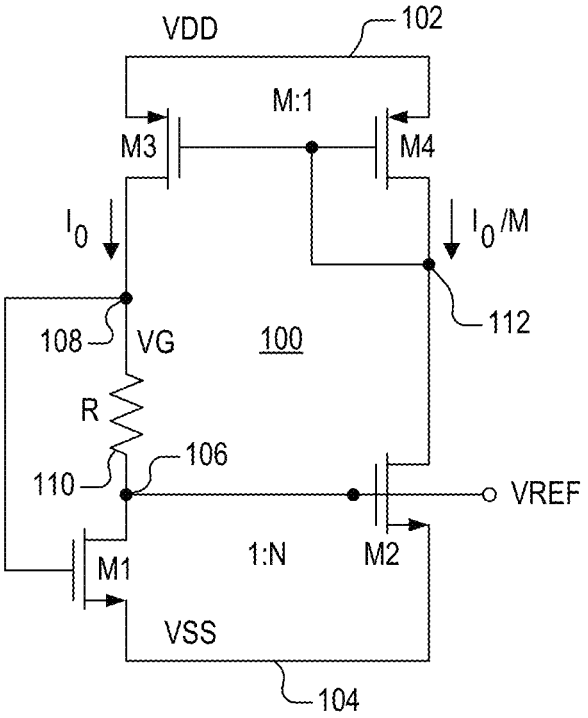
FIG. 1 is a schematic diagram of a voltage reference circuit implemented according to one embodiment of the present disclosure.

FIG. 1 is a schematic diagram of a voltage reference circuit 100 implemented according to one embodiment of the present disclosure. The voltage reference circuit 100 is coupled between an upper supply voltage node 102 and a lower supply voltage node 104. The upper supply voltage node 102 receives an upper supply voltage VDD and the lower supply voltage node 104 receives a lower supply voltage VSS, in which VDD has a voltage level that is greater than the voltage level of VSS. VDD and VSS may each be any positive, negative or zero voltage level in which the difference between VDD and VSS may be any suitable small or large voltage range such as 1 Volt (V) to 5V or more. In one embodiment, for example, VDD may be a selected positive voltage level such as 1 Volt (V) or 3.6V or 5V or the like, and VSS may be a reference or ground level voltage such as 0V. An output node 106 develops a reference voltage VREF which has an intermediate fixed voltage level that remains relatively stable relative to variations of source voltage. It is noted that for the voltage reference circuit 100, VREF is referenced to VSS. As further described herein, parameters of the voltage reference circuit 100 may be selected to ensure that VREF is relatively stable across an operating temperature range. In general, the voltage reference circuit 100 may be used in any product in which a temperature independent, low-noise, high power supply rejection ratio (PSRR) voltage reference is used.

The voltage reference circuit 100 includes several transistors coupled in a current mirror configuration. Different types of transistors may be used, each having a pair of current terminals (e.g., source and drain terminals) and a control terminal (e.g., a gate terminal) or the like. In the illustrated embodiment, MOS-type transistors are used including N-type MOS (NMOS) transistors M1 and M2 and P-type MOS (PMOS) transistors M3 and M4. M1 has a source terminal coupled to the VSS node 104, a drain terminal coupled to the VREF node 106, and a gate terminal coupled to another intermediate node 108 developing a gate voltage VG. A resistor 110 having a resistance R is coupled between nodes 106 and 108. M2 has a source terminal coupled to VSS node 104, a gate terminal coupled to the VREF node 106, and an intermediate node 112. M3 has a source terminal coupled to the VDD node 102, a gate terminal coupled to node 112, and a drain terminal coupled to the VG node 108. M4 has a source terminal coupled to VDD node 102 and gate and drain terminals coupled together at node 112.

The ratio of the size of M1 relative to the size of M2 is 1:N, and the ratio of the size of M3 relative to the size of M4 is M:1. The size of a MOS transistor may be determined by its width to length ratio, or W/L. Relative size may also translate to relative drain current capacity, meaning that a transistor twice the size of another typically means it has twice the drain current capacity assuming other circuit factors are equivalent. Relative size may be achieved by coupling transistors in parallel, such as by doubling the size by coupling two "unit" transistors in parallel with each other. Relative size may also be achieved by adjusting W/L from one transistor to the next, such as by providing a second transistor that is twice the size of the first by doubling the width of the second transistor relative to the width of a first transistor. Regardless of method, it is often desired that the threshold voltage of two transistors targeted for a particular size ratio (e.g., M:1) be the same or substantially equal.

A current Jo flows from the drain terminal of M3, and a corresponding current $I_0/M$ flows from the drain terminal of M4 into the drain terminal of M2 based on the current mirror configuration. In a first configuration, assume that M1 and M2 are operating in saturation (or strong-inversion) region and that drain current $I_D$ verses gate to source voltage ($V_{GS}$) characteristics are governed by a "square-law" relationship having a power factor of 2. In that case, $I_D$ of a given transistor may be determined according to the following equation (1):

$$I_D = \frac{\beta}{2}(V_{GS} - V_{TH})^2 = \frac{\beta\alpha}{2}V_{DSAT}^2 \tag{1}$$

where β is the MOS transistor gain factor, $V_{GS}$ is the gate-to-source voltage, $V_{TH}$ is the MOS threshold voltage, and $V_{DSAT}=V_{GS}-V_{TH}$ is the drain-source saturation voltage of the transistor. For the voltage reference circuit 100, $V_{GS1}=V_{GS2}+I_0R$, where $V_{GS1}$ and $V_{GS2}$ are the gate-to-source voltages of M1 and M2, respectively. Assuming that the threshold voltages $V_{TH1}$ and $V_{TH2}$ of M1 and M2, respectively, are substantially equal, then it is also true that $V_{DSAT1}-V_{DSAT2}=I_0R$, in which $V_{DSAT1}$ and $V_{DSAT2}$ are the drain-source saturation voltages of M1 and M2, respectively. From this relationship, the following equation (2) can be derived:

$$\frac{V_{DSAT1}}{I_0}\left(1 - \frac{V_{DSAT2}}{V_{DSAT1}}\right) = R \tag{2}$$

It is noted that for the square-law case, the transconductance $g_{m1}$ for M1 may be determined as $g_{m1}=2I_0/V_{DSAT1}$. From this relationship, the following equation (3) can be derived:

$$g_{m1}R = 2\left(1 - \frac{1}{\sqrt{MN}}\right) \tag{3}$$

where R is the resistance of the resistor 110 and M and N are the size ratios of the MOS transistors M1-M4 shown in FIG. 1.

In the first configuration in which the $I_D$ verses $V_{GS}$ characteristics of M1 and M2 are governed by the square-law relationship, M and N are chosen such that $\sqrt{MN}=2$ so that $g_{m1}R=1$. Referring again to FIG. 1, a small signal analysis of the reference voltage can be provided as $VREF=(1-g_{m1}R)VG$, so that if M and N are chosen such that $g_{m1}R=1$, then the small signal gain is effectively zero. This implies that any noise coupled from the supply voltages VDD or VSS is suppressed, and that any noise injected from the other components M2, M3 or M4, is also suppressed. For similar reasons, VREF is relatively insensitive to the offset voltages of M2, M3, and M4. As an example, M and N can both be chosen such that M=N=2. With reference to the voltage reference circuit 100, this means that M3 is twice the size of M4 and that M2 is twice the size of M1. With this choice a high PSSR, low noise reference voltage VREF can be generated. VREF can be determined by the following equation (4):

$$VREF = V_{TH1} + \frac{V_{DSAT1}}{2} = V_{TH1} + I_0R \tag{4}$$

It may also be shown that the average noise power present on VREF is set by noise of the resistance R and the transistor M1 only according to the following equation (5):

$$v_{n,REF}^2 = 4kTR\left(1 + \frac{2}{3}\gamma\right)\left[\frac{V^2}{\text{Hz}}\right] \tag{5}$$

in units of Volts (V) squared per Hertz ($V^2$/Hz), where T is absolute temperature in Kelvin (K), k is the Boltzmann constant in energy (Joules) divided by temperature (J/K), and γ is the excess noise factor of M1.

In a more general case, assume that the $I_D$ verses $V_{GS}$ characteristics of M1 and M2 deviate somewhat from the exact square-law relationship and instead operate according to an "α-power-law" relationship with a power factor of a rather than a power factor of 2. It is noted that the α factor is near to but deviates somewhat from the power factor of 2. Such deviation may occur for a variety of reasons, such as mobility degradation and velocity saturation effects or when the operation point is close to the moderate inversion region. In this case, M1 operates according to a more general power-law relationship referred to herein as the α-power-law relationship in which the drain current relationship to the $V_{GS}-V_{TH}$ voltage is given by $$I_D = \frac{\beta}{2}(V_{GS} - V_{TH})^\alpha = \frac{\beta}{2}(V_{DSAT})^\alpha.$$

For the α-power-law relationship, the transconductance $g_{m1}$ of M1 is determined instead as $g_{m1}=\alpha I_0/V_{DSAT1}$. From this relationship, the following equation (6) can be derived:

$$g_{m1}R = \alpha\left(1 - \frac{1}{(MN)^{\frac{1}{\alpha}}}\right) \tag{6}$$

where, again, R is the resistance of the resistor 110 and M and N are the size ratios of the MOS transistors M1-M4 of the voltage reference circuit 100. In this case, M and N are chosen according to the following equation (7):

$$MN = \left(\frac{\alpha}{\alpha - 1}\right)^{\alpha} \tag{7}$$

so that $g_{m1}R=1$. For example, if $\alpha=1.8$, then MN=4.3, or if $\alpha=2.2$, then MN=3.8, and so on. Also, noise on VREF is set only by noise of R and M1 only and any noise signal contribution of supply voltage, M2, M3 or M4 is effectively canceled.

Equation (6) is shown at 120 in FIG. 1 defining the general $\alpha$-power-law relationship for each of the configurations, and the corresponding choice of M and N is shown at 122 to achieve high PSRR and low noise as described herein. The determination of the power factor $\alpha$ may be made empirically for each given configuration. It is noted that if $\alpha=2$, then the $I_D$ verses $V_{GS}$ characteristics of M1 and M2 are governed by the square-law relationship previously described.

It can be shown that the reference voltage is determined as $VREF=V_{TH}+I_0R$ in which the temperature dependent threshold voltage has the form $V_{TH}(T)=V_{TH}(T_0)-\sigma_1T$ in which $\sigma_1$ is a positive constant and $T_0$ is a nominal temperature, such as, for example, $T_0=27°$ Celsius (° C.). In addition, the current $I_0$ increases almost linearly as temperature increases, or $I_0(T)=I_0(T_0)+\sigma_2T$ in which $\sigma_2$ is another positive constant. In this manner, the reference voltage as a function of temperature, or VREF(T), may be determined according to the following equation (8):

$$\mathrm{VREF}(T)=V_{TH}(T_0)+RI_0(T_0)+(RI_0\sigma_2-\sigma_1)T \tag{8}$$

By adjusting the value of $RI_0$ by either changing the value of R, or changing the value of W/L of device M1 (with a corresponding change of M2 to maintain 1:N size ratio), or more generally, by a combination of both, a temperature independent reference voltage VREF can be realized over an operating temperature range. In one embodiment, the operating temperature range is −40° C. to +140° C. It is noted that the temperature dependence of threshold voltage and drain current have higher exponent terms, which causes a curvature of the VREF versus temperature characteristics of the voltage reference circuit 100 over the operating temperature range.

Figure 2:
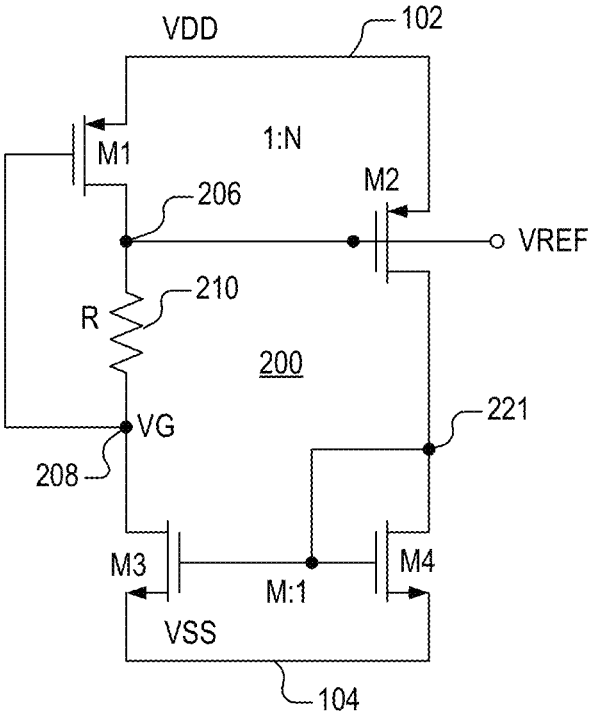
FIG. 2 is a schematic diagram of a voltage reference circuit implemented according to a PMOS embodiment of the present disclosure.

FIG. 2 is a schematic diagram of a voltage reference circuit 200 implemented according to a PMOS embodiment of the present disclosure. The voltage reference circuit 200 may be considered a PMOS variation of the voltage reference circuit 100, which is an NMOS variation. In this case, M1 and M2 are instead PMOS transistors and M3 and M4 are instead NMOS transistors. The size ratio of M1 to M2 is 1:N and the size ratio of M3 to M4 is M:1 in the same manner as for the voltage reference circuit 100. For the voltage reference circuit 200, the source terminals of M1 and M2 are coupled to the VDD node 102 and the source terminals of M3 and M4 are coupled to the VSS node 104. The drain terminal of M1 and the gate terminal of M2 are both coupled together at an output node 206 developing a reference voltage VREF. The gate terminal of M1 is coupled to a gate node 208 developing a voltage VG and a resistor 210 with resistance R is coupled between nodes 206 and 208. M2 has its drain terminal coupled to the drain terminal of M4 and to the gate terminals of M3 and M4 at an intermediate node 212.

In a similar manner as described for the voltage reference circuit 100, equation (6) is also shown at 120 in FIG. 2 defining the general $\alpha$-power-law case for each of the configurations, and the corresponding choice of M and N is shown at 122 to achieve high PSRR and low noise as described herein. The determination of the power factor $\alpha$ may be made empirically for each given configuration. It is noted that if $\alpha=2$, then the $I_D$ verses $V_{GS}$ characteristics of M1 and M2 are governed by the square-law relationship previously described.

The voltage reference circuit 200 develops the reference voltage VREF which remains relatively stable relative to variations of source voltage (VDD/VSS) and the VG voltage due to noise or ground bounce. VREF developed by the voltage reference circuit 200 may have a different voltage level as compared to VREF developed by the voltage reference circuit 100. In a similar manner as described above for the voltage reference circuit 100, parameters of the voltage reference circuit 200 may be selected to ensure that VREF is relatively stable across an operating temperature range, such as, for example, −40° C. to +140° C. For example, by adjusting the value of $RI_0$ by either changing the value of R, or changing the value of W/L of device M1 (with a corresponding change of M2 to maintain 1:N size ratio), or more generally, by a combination of both, a temperature independent reference voltage VREF can be realized over an operating temperature range. It is noted that for the voltage reference circuit of 200, VREF is referenced to the positive supply VDD rather than VSS.

Figure 3:
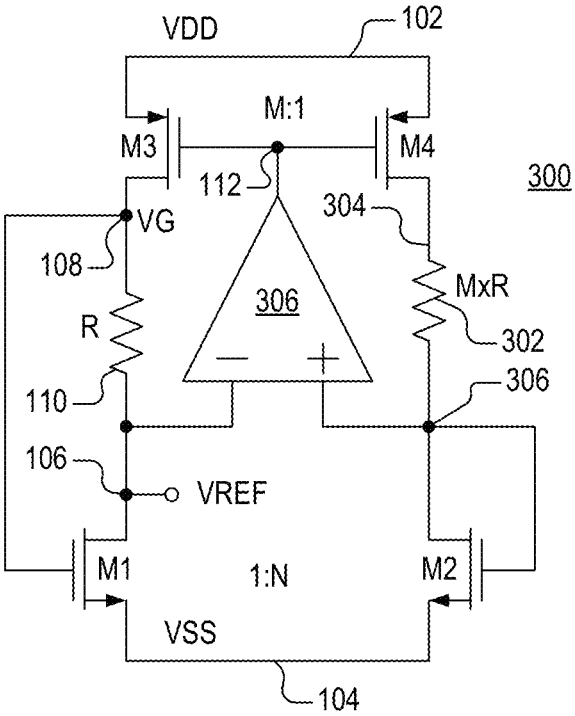
FIG. 3 is a schematic diagram of a voltage reference circuit implemented according to yet another embodiment of the present disclosure including an operational amplifier.

FIG. 3 is a schematic diagram of a voltage reference circuit 300 implemented according to yet another embodiment of the present disclosure including an operational amplifier (OA) 306. The voltage reference circuit 300 is substantially similar to the voltage reference circuit 100 in which similar components assume identical reference numerals. M1 and M2 are NMOS transistors and M3 and M4 are PMOS transistors that are included and coupled in a similar manner. The size ratio of M1 to M2 is 1:N and the size ratio of M3 to M4 is M:1 in similar manner. The source terminals of M1 and M2 are coupled to the VSS node 104 and the source terminals of M3 and M4 are coupled to the VDD node 102 in similar manner. The gate terminal of M3 is coupled to the gate terminal of M4 at node 112 in similar manner. The drain terminal of M3 is coupled to node 108, which is further coupled to one end of resistor 110 having resistance R and to the gate terminal of M1. The other end of the resistor 110 is coupled to output node 106 developing VREF, which is also coupled to the gate of M2 in similar manner.

The voltage reference circuit 300, however, includes the OA 306 and an additional resistor 302 having a resistance M×R so that the resistance of the resistor 302 is M times that of the resistance R of the resistor 110. This ensures that the voltage at node 304 is ideally equal to the voltage at node 108 for better symmetry. The drain terminal of M4 is not coupled to node 112, but is instead coupled to one end of the resistor 302 at a node 304, having its other end coupled to the drain terminal of M2 at a node 306. The OA 306 has an inverting input coupled to node 106, a non-inverting input coupled to node 306, and an output coupled to node 112. The gate terminal of M2 is not coupled to the output node 106, but is instead coupled to its drain terminal at node 306.

In a similar manner as described for the voltage reference circuit 100, equation (6) is also shown at 120 in FIG. 2 defining the general $\alpha$-power-law relationship for each of the configurations, and the corresponding choice of M and N is shown at 122 to achieve high PSRR and low noise as described herein. The determination of the power value α may be made empirically for each given configuration. It is noted that if α=2, then the $I_D$ verses $V_{GS}$ characteristics of M1 and M2 are governed by the square-law relationship previously described. Compared to the voltage reference 100, the voltage reference circuit 300 typically has higher lower frequency PSRR but degraded higher frequency PSRR. If better high frequency PSRR is needed, a passive filter may be provided at the output.

The voltage reference circuit 300 develops the reference voltage VREF which remains relatively stable relative to variations of source voltage and any noise present at voltage VG at node 108. VREF developed by the voltage reference circuit 300 may have a different voltage level as compared to VREF developed by the voltage reference circuit 100. In a similar manner as described above for the voltage reference circuit 100, parameters of the voltage reference circuit 300 may be selected to ensure that VREF is relatively stable across an operating temperature range, such as, for example, −40° C. to +140° C. For example, by adjusting the value of $RI_0$ by either changing the value of R, or changing the value of W/L of device M1 (with a corresponding change of M2 to maintain 1:N size ratio), or more generally, by a combination of both, a temperature independent reference voltage VREF can be realized over an operating temperature range.

Other variations of the voltage reference circuits 100, 200, and 300 are possible and contemplated. For example, M3 and M4 in each of the voltage reference circuits 100, 200, and 300 may be replaced by cascoded transistors, meaning multiple MOS transistors having current terminals coupled in series. Although not shown, the voltage reference circuit 300 may be realized as a PMOS version (in an analogous manner as the voltage reference circuit 200 as a PMOS version relative to the voltage reference circuit 100 as an NMOS version). In particular, the diode-connection of NMOS transistor M4 of the voltage reference circuit 200 may be removed and a resistor with resistance M×R may be inserted between the drain terminals of M2 and M4. The gate terminal of M2 is not coupled to the output node 206 but instead is diode-coupled to its drain terminal. In addition, an operational amplifier may have its inputs coupled to the drain terminals of PMOS transistors M1 and M2 and its output coupled to the gate terminals of M3 and M4. Operation is substantially similar.

Figure 4:
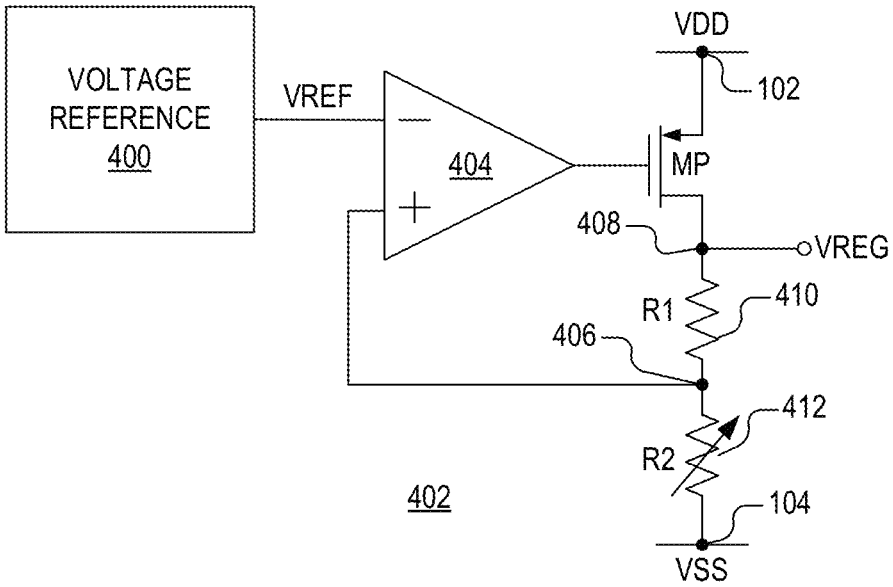
FIG. 4 is a schematic and block diagram of a voltage regulator using a voltage reference circuit implemented according to one embodiment of the present disclosure.

FIG. 4 is a schematic and block diagram of a voltage regulator 400 using a voltage reference circuit 400 implemented according to one embodiment of the present disclosure. The voltage reference circuit 400 provides a reference voltage VREF and may be implemented according to either of the voltage reference circuits 100 or 300 or any of their variants as described herein. VREF is provided to an inverting input of an operational amplifier (OA) 404, having a non-inverting input coupled to a junction node 406 and an output coupled to a gate terminal of a PMOS transistor MP. MP has a source terminal coupled to the VDD supply voltage node 102 and has a drain terminal coupled to an output node 408 developing a regulated voltage VREG referenced to VSS. A 410 with resistance R2 is coupled between nodes 408 and 406, and another resistor 412 with a resistance R1 is coupled between node 406 and the VSS supply voltage node 104. The voltage reference circuit 400 may be configured as described herein to develop VREF at a relatively constant voltage level across a relatively wide operating temperature range.

In operation, the OA 404 drives MP to keep the voltage at node 406 at the same voltage as VREF so that VREG has a voltage based on the ratio of resistances R1 and R2. The voltage regulator 400, for example, operates as a low-dropout regulator so that VREG=(1+R2/R1)VREF. VREF may have some variation across process due the threshold voltage variation from one configuration to the next. If it is desired to keep the VREG more tightly controlled than the VREF variation due to process, the resistance R1 may be variable or programmable as shown to be adjusted to calibrate VREG to the desired voltage level.

Figure 5:
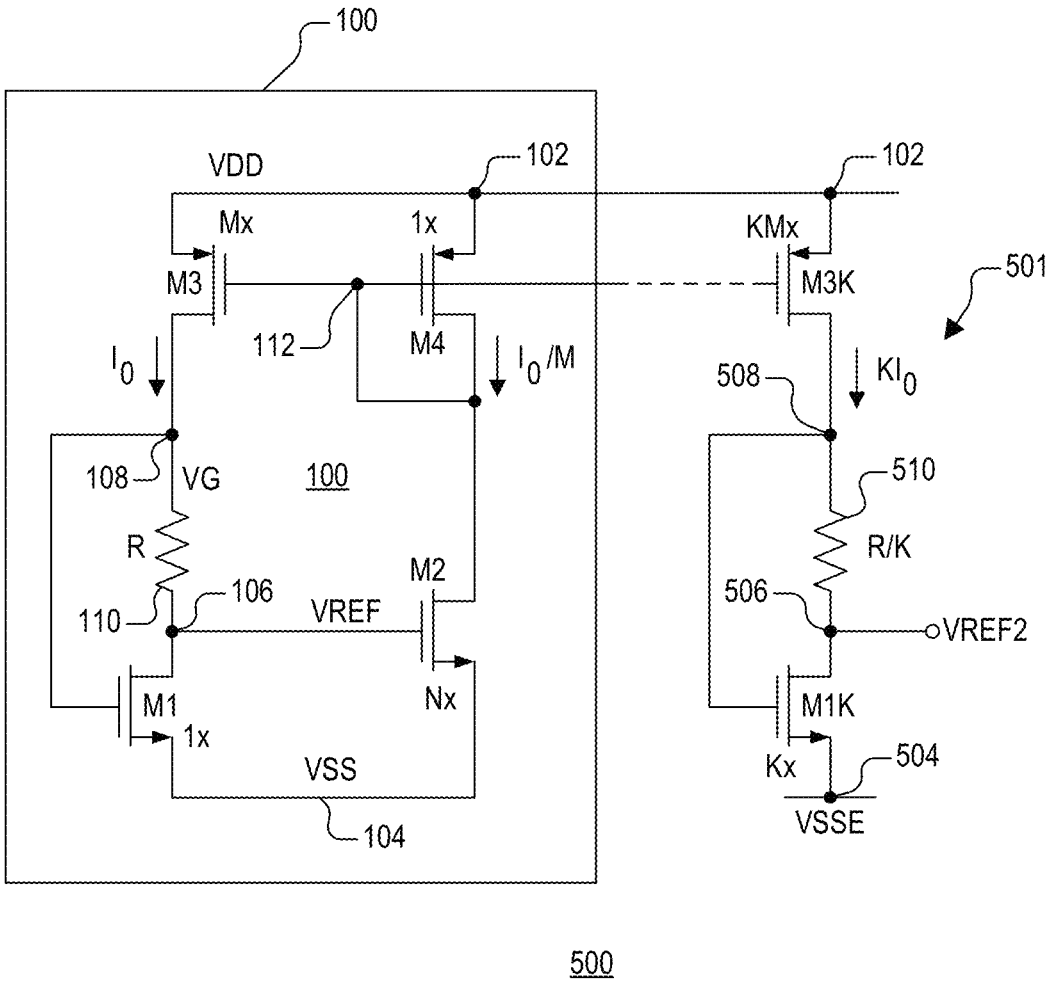
FIG. 5 is a schematic and block diagram of a voltage reference circuit including an additional reference branch implemented according to one embodiment of the present disclosure.

FIG. 5 is a schematic and block diagram of a voltage reference circuit 500 including an additional reference branch 501 implemented according to one embodiment of the present disclosure. The voltage reference circuit 500 includes the voltage reference circuit 100 and the reference branch 501 which provides a separate reference voltage VREF2 on a separate output node 506. The voltage level of VREF2 is normally the same as the voltage level of VREF on node 106. Although only one additional reference branch is shown, it is understood that any number of additional reference branches may be included. The reference branch 501 is coupled between the VDD node 102 and a lower supply voltage node 504 developing a lower supply voltage VSSE. The VSSE node 504 may be an extension of the VSS node 104 or an independent reference node. The VSSE node 504 is generally a local reference voltage supply node for the reference branch 501. The voltage reference circuit 100 and M3K may be at one location of a semiconductor chip or integrated circuit (IC), whereas the reference branch 501 may be located at a different location of the IC, in which the two locations may be relatively distant or remote with respect to each other. It is noted that M3K is normally placed near or adjacent to the voltage reference circuit 100.

The reference branch 501 includes a PMOS transistor M3K having a source terminal coupled to the VDD node 102, a gate terminal coupled to the node 112, and a drain terminal coupled to another gate node 508. The reference branch 501 also includes an NMOS transistor M1K having a source terminal coupled to a lower supply voltage node 504, a gate terminal coupled to the gate node 508, and a drain terminal coupled to the output node 506. Another resistor 510 is coupled between nodes 506 and 508. A size ratio of M3K to M3 is K:1 (or KM:M) and a size ratio of M1K to M1 is also K:1, where K is any suitable factor value. Also, a resistance of the resistor 510 is R/K or the resistance R of the resistor 110 divided by the factor K. M3K develops a drain current of $KI_0$, which is K times the drain current $I_0$ of M3. It may be desired to provide a larger current by selecting K greater than 1 (K>1) if a lower noise reference is needed. The reference branch 501 develops VREF2 with high PSRR with respect to VDD and VSSE. The local ground connection to VSSE does not degrade performance.

Figure 6:
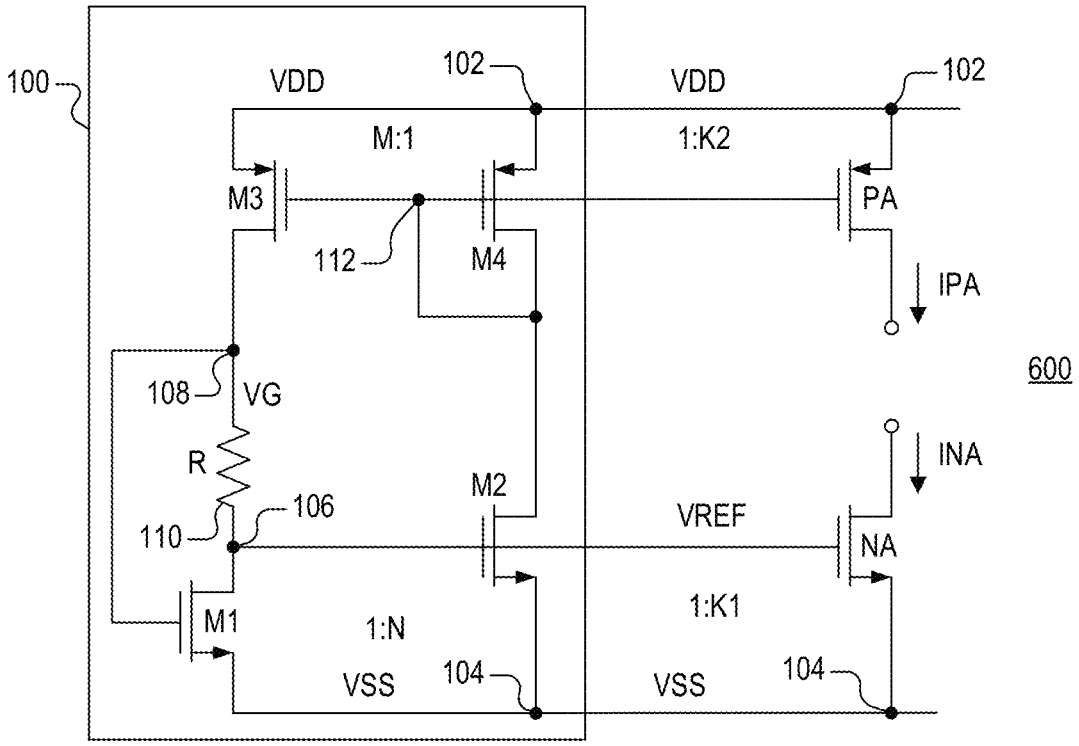
FIG. 6 is a schematic diagram of a current bias generator using the voltage reference circuit of FIG. 1 according to one embodiment of the present disclosure.

FIG. 6 is a schematic diagram of a current bias generator 600 using the voltage reference circuit 100 according to one embodiment of the present disclosure. The current bias generator 600 includes the voltage reference circuit 100 and may include either a PMOS transistor PA, or an NMOS transistor NA, or may include both. PA, if included, has a source terminal coupled to the VDD node 102 and a gate terminal coupled to node 112, and NA, if included, has a source terminal coupled to the VSS node 104 and a gate terminal coupled to node 106 for receiving VREF. PA includes a drain terminal providing a bias current IPA and NA has a drain terminal sinking a bias current INA. The size ratio of M4 to PA is 1:K2, and the size ratio of M2 to NA is 1:K1, in which K1 and K2 are factor values. It is noted that the bias currents IPA and INA are proportional to absolute temperature currents (IPTAT). Since VREF has low-noise (noise from M1 and resistor 110 only), the currents INA and IPA can have relatively low-noise compared to conventional IPTAT generators that do not impose the gmR=1 constraint or the more commonly used IPTAT generators in which a resistor is placed between source of M2 and VSS.

Figure 7:
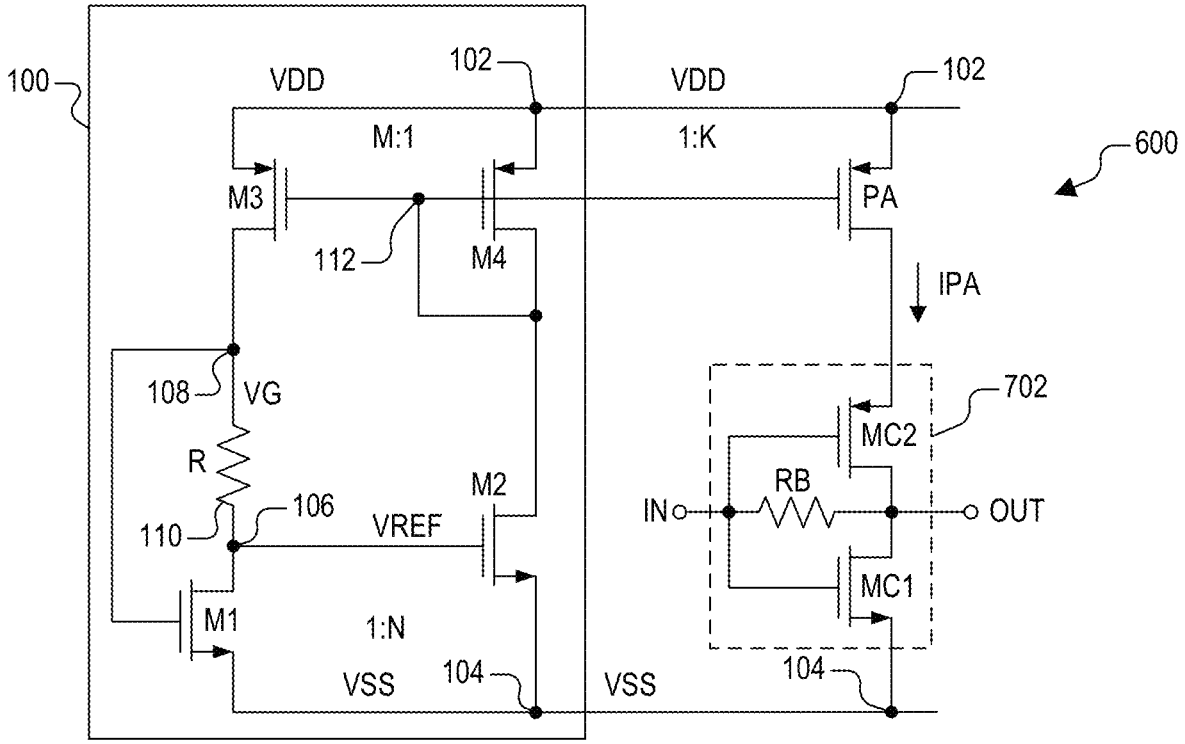
FIG. 7 is a schematic diagram illustrating an example of an application of the current bias generator of FIG. 6 driving a functional circuit.

FIG. 7 is a schematic diagram illustrating an example of an application of the current bias generator 600 driving a functional circuit 702, such as a crystal (XTAL) oscillator or a low-noise amplifier (LNA) or the like. The current bias generator 600 includes PA having a 1:K size ratio relative to M4 and provides bias current IPA to the functional circuit 702. The functional circuit 702 includes MOS transistors MC1 and MC2 with transconductances gm1 and gm2, respectively, and is not further described. The bias current IPA from the current bias generator 600 forces gm1 and gm2 to be constant across variations of temperature.

Figure 8:
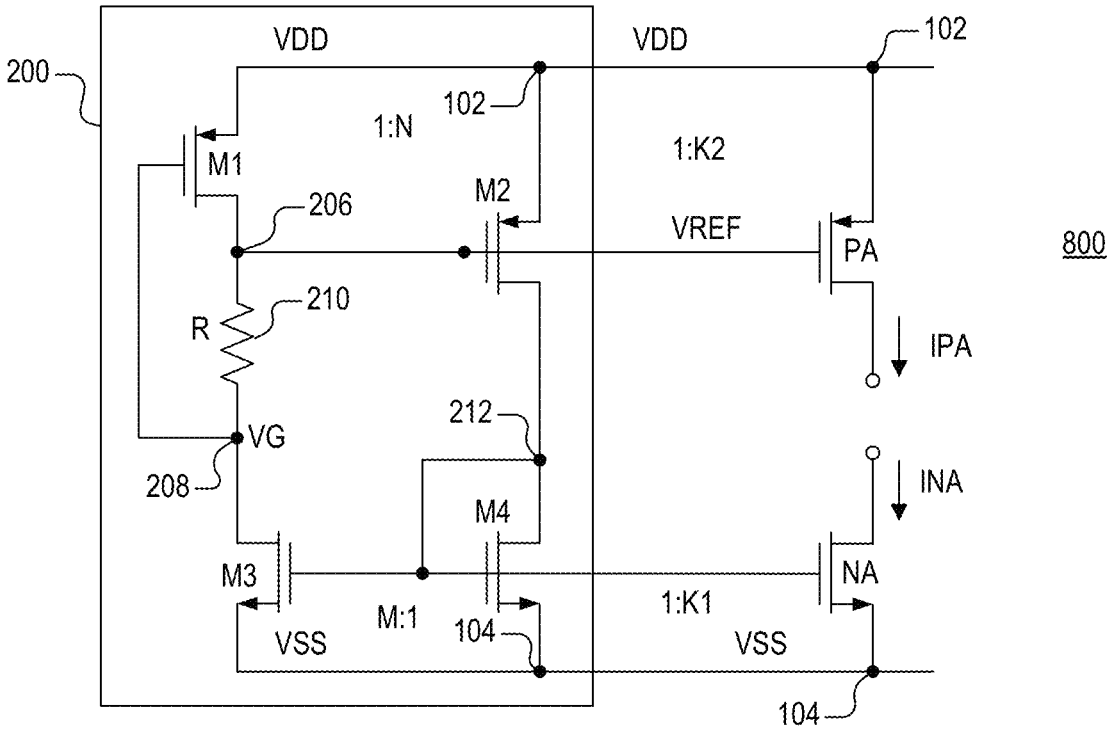
FIG. 8 is a schematic diagram of a current bias generator using the voltage reference circuit of FIG. 2 according to a PMOS embodiment of the present disclosure.

FIG. 8 is a schematic diagram of a current bias generator 800 using the voltage reference circuit 200 according to one embodiment of the present disclosure, in which the current bias generator 800 is a PMOS version of the NMOS current bias generator 600. The current bias generator 800 includes the voltage reference circuit 200 and may include either a PMOS transistor PA, or an NMOS transistor NA, or may include both. PA, if included, has a source terminal coupled to the VDD node 102 and a gate terminal coupled to node 206 for receiving VREF, and NA, if included, has a source terminal coupled to the VSS node 104 and a gate terminal coupled to node 212. PA includes a drain terminal providing a bias current IPA and NA has a drain terminal receiving a bias current INA. The size ratio of M2 to PA is 1:K2, and the size ratio of M4 to NA is 1:K1, in which K1 and K2 are factor values. Note that the bias currents IPA and INA are IPTAT currents as previously described.

Figure 9:
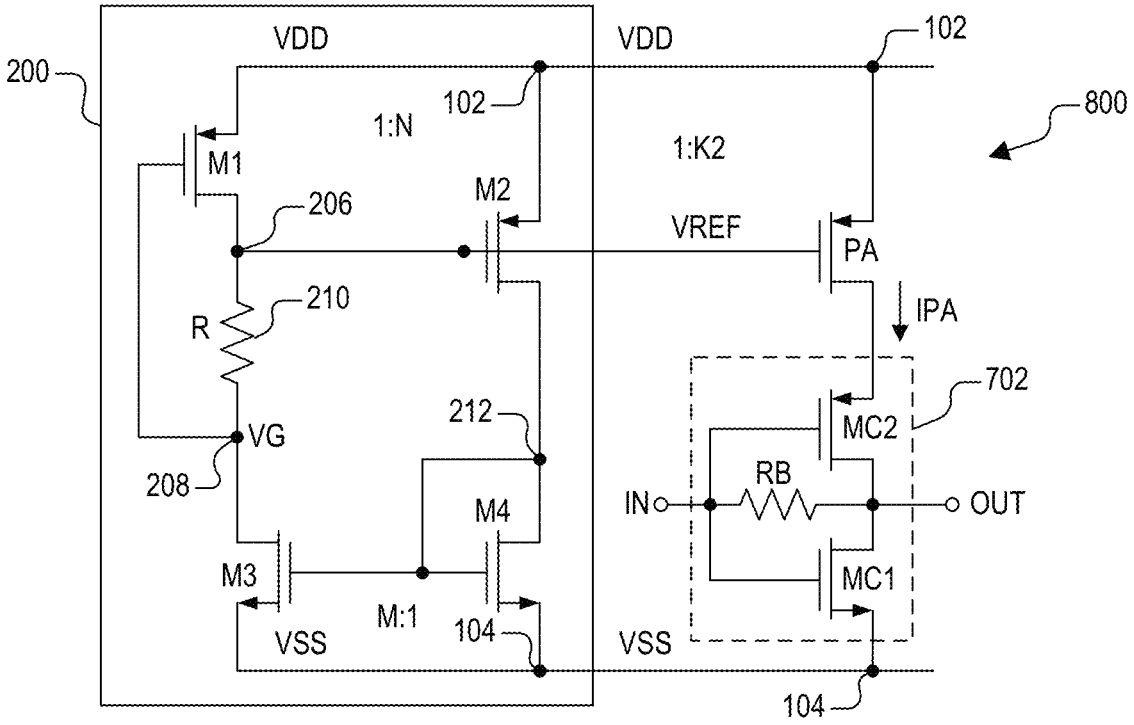
FIG. 9 is a schematic diagram illustrating an example of an application of the current bias generator of FIG. 8 driving a functional circuit.

FIG. 9 is a schematic diagram illustrating an example of an application of the current bias generator 800 driving the functional circuit 702 in a similar manner as previously described for the current bias generator 800. The current bias generator 800 includes PA having a 1:K size ratio relative to M4 and provides bias current IPA to the functional circuit 702. Again, the functional circuit 702 includes MOS transistors MC1 and MC2 with transconductances gm1 and gm2, respectively, and is not further described. The bias current IPA from the current bias generator 800 forces gm1 and gm2 to be constant across temperature variations.

Figure 10:
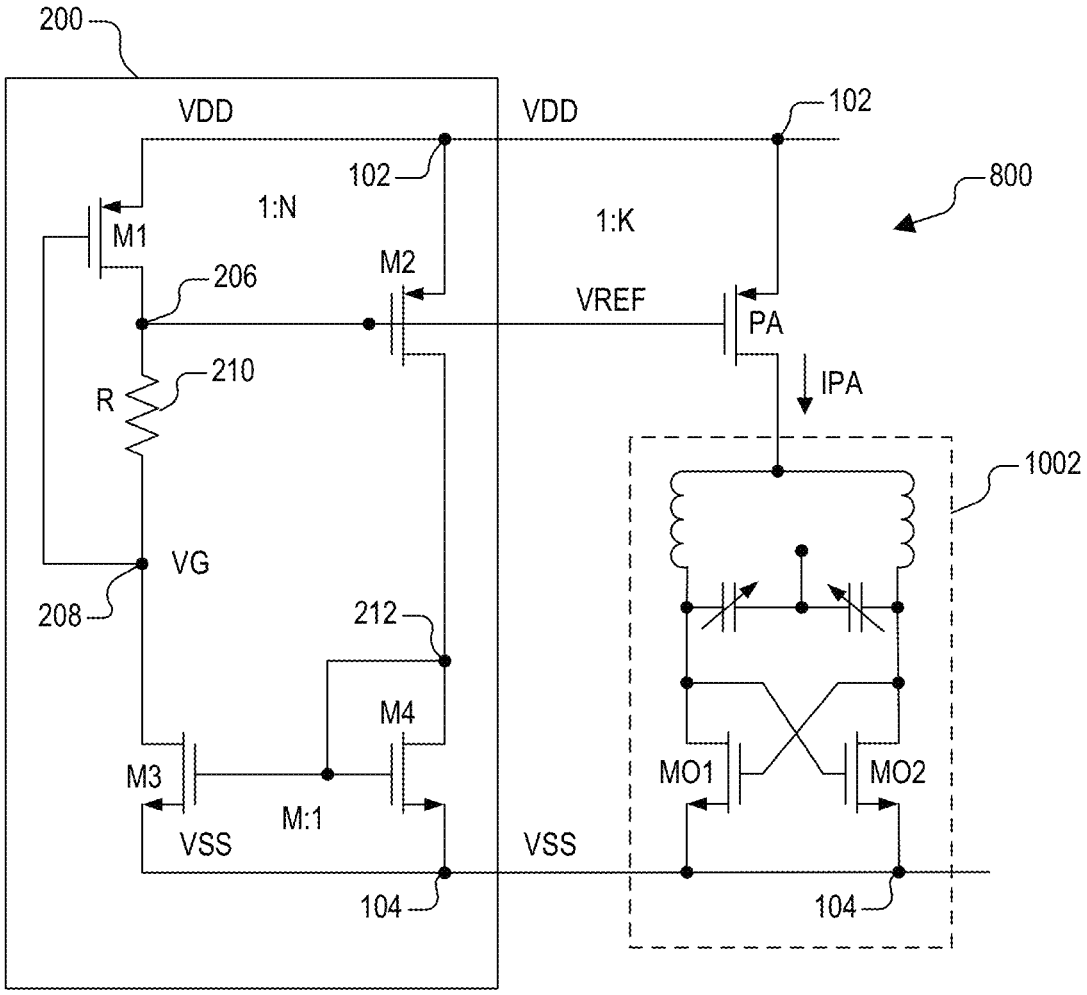
FIG. 10 is a schematic diagram illustrating an example of an application of the current bias generator of FIG. 8 driving another functional circuit.

FIG. 10 is a schematic diagram illustrating an example of an application of the current bias generator 800 driving a functional circuit 1002, such as an inductance-capacitance (LC) voltage-controlled oscillator (VCO) or the like. The current bias generator 800 includes PA having a 1:K size ratio relative to M4 and provides bias current IPA to the functional circuit 1002. The functional circuit 702 includes MOS transistors MO1 and MO2 with transconductances gm1 and gm2, respectively, and is not further described. The bias current IPA from the current bias generator 800 forces gm1 and gm2 to be constant across temperature variations.

Figure 11:
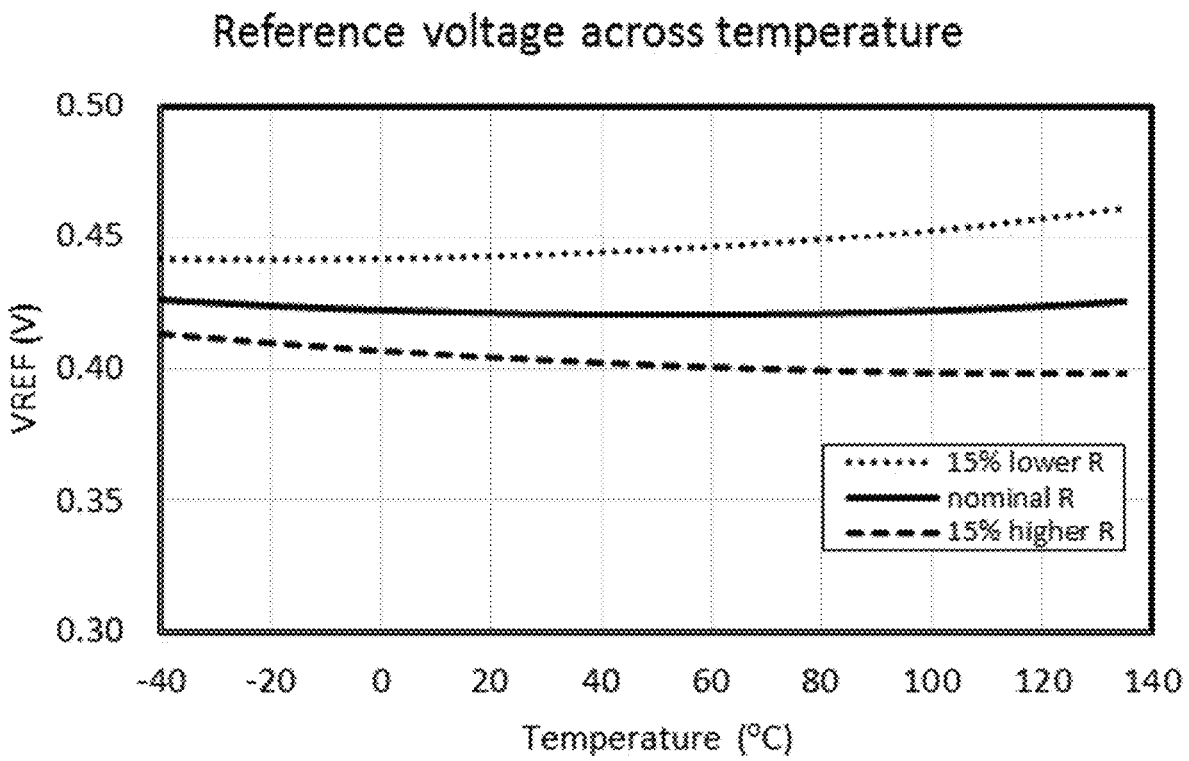
FIG. 11 are plots of the reference voltage versus temperature for a nominal value of the resistance R and 15% resistance variations for configurations of the voltage reference circuits of FIGS. 1 and 3.

FIG. 11 are plots of the reference voltage VREF in Volts versus temperature in degrees Celsius (° C.) for a nominal value of the resistance R and 15% resistance variations for configurations of the voltage reference circuits 100 and 300. A nominal resistance may be determined to achieve a relatively flat VREF variance over a relatively wide temperature range. In one embodiment, a nominal resistance R is about 20 Kilohms (KΩ). Similar results are achievable for the voltage reference circuit 200.

Figure 12:
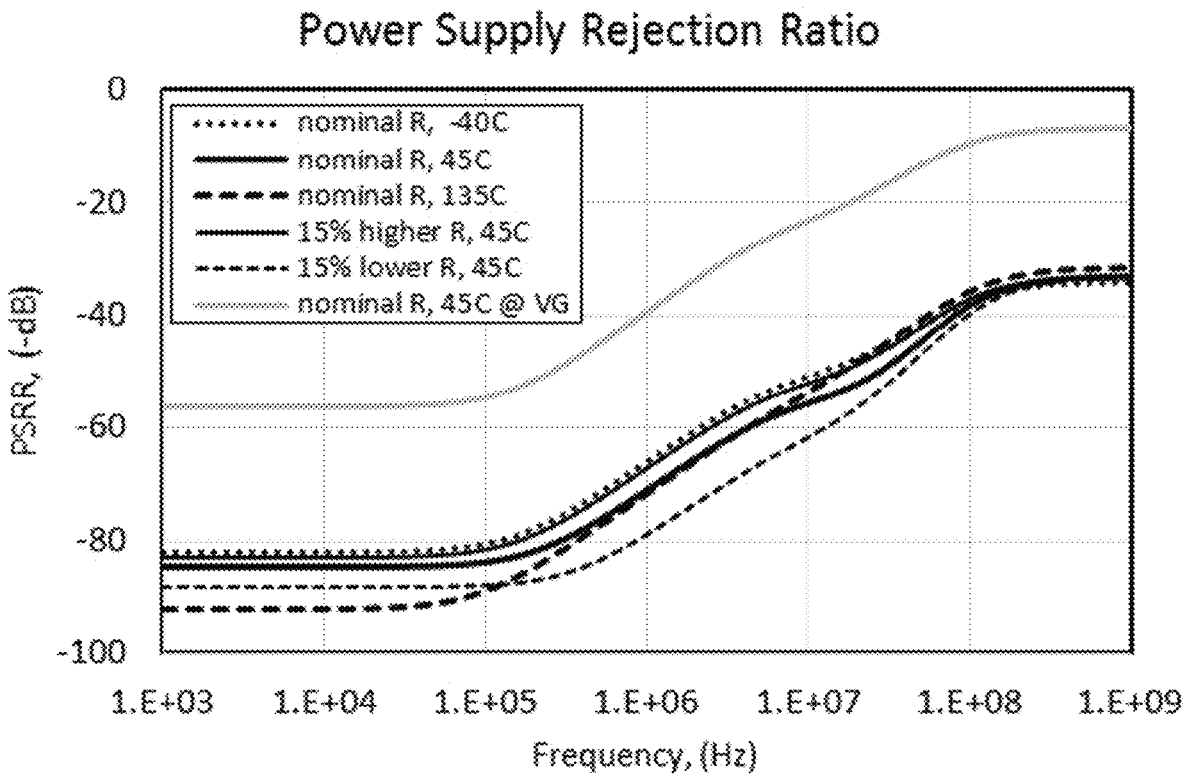
FIG. 12 are plots of the PSRR versus Frequency for a nominal value of the resistance R and 15% resistance variations at several temperature values of the voltage reference circuits of FIGS. 1-3.

FIG. 12 are plots of the PSRR in negative dB versus Frequency in Hertz for a nominal value of the resistance R and 15% resistance variations at several temperature values of the voltage reference circuits 100 and 200. Although not shown, the PSRR of the voltage reference circuit 300 is better at the lower frequencies but not as good at the higher frequencies as previously described. Also plotted is the PSRR at the gate voltage VG using the nominal resistance R at 45° C. It is appreciated that at least 20 dB improvement is achieved at VREF versus VG.

Figure 13:
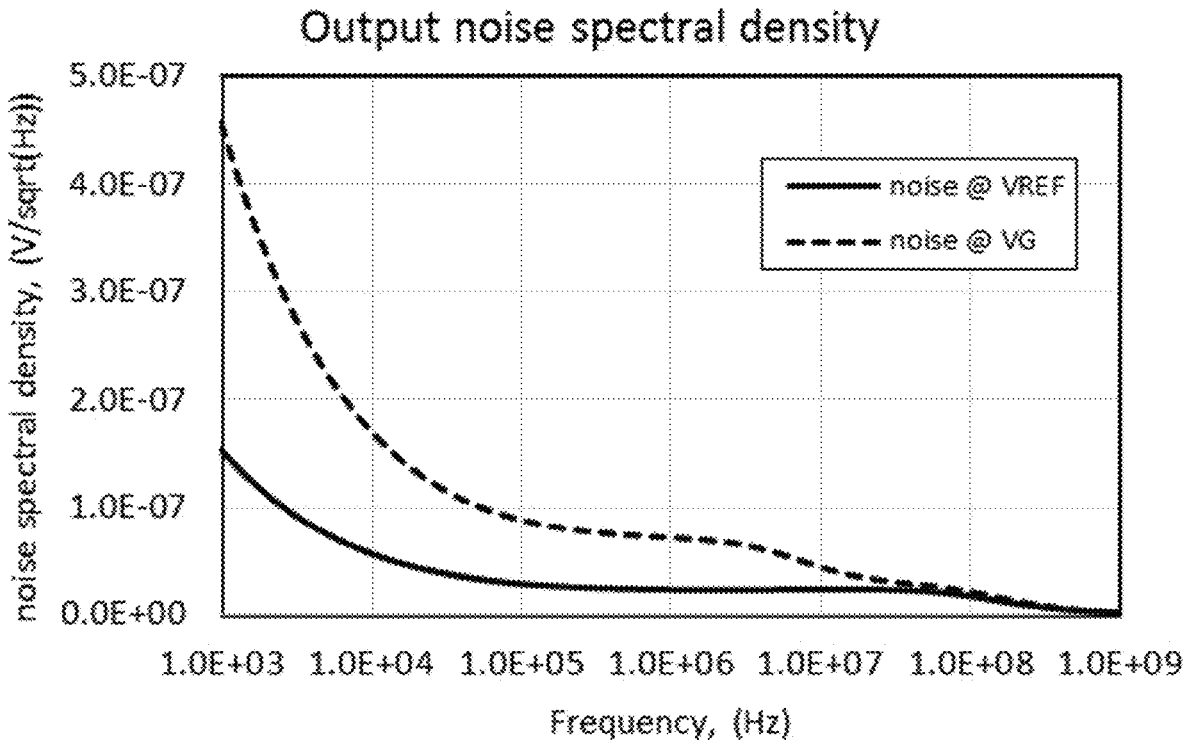
FIG. 13 are plots of the output noise spectral density versus Frequency for the voltages VREF and VG of the voltage reference circuits of FIGS. 1-3.

FIG. 13 are plots of the output noise spectral density in V/$\sqrt{\text{Hz}}$ versus Frequency in Hertz for the voltages VREF and VG of the voltage reference circuits 100. It is appreciated that the noise spectral density of VREF is substantially less than that of VG particularly at the lower frequency levels. Although not shown, the output noise spectral density for the voltage reference circuits 200 and 300 is substantially similar though not exactly the same.

The present description has been presented to enable one of ordinary skill in the art to make and use the present invention as provided within the context of particular applications and corresponding requirements. The present invention is not intended, however, to be limited to the particular embodiments shown and described herein, but is to be accorded the widest scope consistent with the principles and novel features herein disclosed. Many other versions and variations are possible and contemplated. Those skilled in the art should appreciate that they can readily use the disclosed conception and specific embodiments as a basis for designing or modifying other structures for providing the same purposes of the present invention without departing from the spirit and scope of the invention.

The invention claimed is:

1. A voltage reference system, comprising:

a voltage reference circuit, comprising:

a first transistor of a first conductivity type having first and second current terminals coupled between a first supply voltage node and an output node which provides a reference voltage, and having a control terminal coupled to a first node;

a second transistor of the first conductivity type having first and second current terminals coupled between the first supply voltage node and a second node, and having a control terminal coupled to the output node;

a first transistor of a second conductivity type having first and second current terminals coupled between a second supply voltage node and the first node, and having a control terminal coupled to the second node;

a second transistor of the second conductivity type having first and second current terminals coupled between the second supply voltage node and the second node, and having a control terminal coupled to the second node; and a first resistive device coupled between the first node and the output node;

wherein the first and second transistors of the first conductivity type are governed by an α-power-law relationship having a power factor α, wherein a size ratio of the first and second transistors of the first conductivity type is 1:N, wherein a size ratio of the first and second transistors of the second conductivity type is M:1, wherein M and N are selected such that a multiple of M times N is equal to $(\alpha/(\alpha-1))^{\alpha}$, and wherein the width to length ratio of the first transistor and the resistance of the first resistive device are selected so that the reference voltage is independent of temperature over an operating temperature range.

2. The voltage reference system of claim 1, wherein the first and second transistors of the first conductivity type are governed by a square-law relationship when the power factor $\alpha$ is equal to 2, so that M and N are selected so that the multiple of M times N is equal to 4.

3. The voltage reference system of claim 1, wherein given gm is a transconductance of the first transistor of the first conductivity type and R is a resistance of the first resistive device, then gm multiplied by R is equal to $\alpha(1-1/(MN)^{1/\alpha})$.

4. The voltage reference system of claim 1, wherein the first supply voltage node develops a lower supply voltage, wherein the second supply voltage node develops an upper supply voltage, wherein the first conductivity type is N-type, and wherein the second conductivity type is P-type.

5. The voltage reference system of claim 1, wherein the first and second transistors of the first conductivity type are each NMOS transistors, wherein the first and second transistors of the second conductivity type are each PMOS transistors, and wherein the reference voltage is referenced to a supply reference voltage developed on the first supply voltage node.

6. The voltage reference system of claim 1, wherein the first supply voltage node develops an upper supply voltage, wherein the second supply voltage node develops a lower supply voltage, wherein the first conductivity type is P-type and wherein the second conductivity type is N-type.

7. The voltage reference system of claim 1, wherein the first and second transistors of the first conductivity type are each PMOS transistors, wherein the first and second transistors of the second conductivity type are each NMOS transistors, and wherein the reference voltage is referenced to an upper supply voltage developed on the first supply voltage node.

8. The voltage reference system of claim 1, further comprising:

a voltage regulator, comprising:

an operational amplifier having a first input receiving the reference voltage, having a second input coupled to a junction node, and having an output;

a third transistor of the second conductivity type having current terminals coupled between the second supply voltage node and a regulated node developing a regulated voltage, and having a control input coupled to the output of the operational amplifier;

a junction resistor having a first terminal coupled to the regulated node and having a second terminal coupled to the junction node; and an adjustable resistor coupled between the junction node and the first supply voltage node, wherein a resistance of the adjustable resistor is adjusted to set a voltage level of the regulated voltage.

9. The voltage reference system of claim 1, further comprising a third transistor of the second conductivity type having first and second current terminals coupled between the second supply voltage node and a third node and having a control terminal coupled to the second node, and wherein the third transistor develops a current that is proportional to absolute temperature.

10. The voltage reference system of claim 9, wherein the first conductivity type is N-type, wherein the second conductivity type is P-type, and wherein the third transistor sources the current that is proportional to absolute temperature.

11. The voltage reference system of claim 9, wherein the first conductivity type is P-type, wherein the second conductivity type is N-type, and wherein the third transistor sinks the current that is proportional to absolute temperature.

12. A voltage reference circuit, comprising:

a first transistor of a first conductivity type having first and second current terminals coupled between a first supply voltage node and an output node which provides a reference voltage, and having a control terminal coupled to a first node;

a second transistor of the first conductivity type having first and second current terminals coupled between the first supply voltage node and a second node, and having a control terminal coupled to the output node;

a first transistor of a second conductivity type having first and second current terminals coupled between a second supply voltage node and the first node, and having a control terminal coupled to the second node;

a second transistor of the second conductivity type having first and second current terminals coupled between the second supply voltage node and the second node, and having a control terminal coupled to the second node;

a first resistive device coupled between the first node and the output node;

wherein the first and second transistors of the first conductivity type are governed by an $\alpha$-power-law relationship having a power factor $\alpha$, wherein a size ratio of the first and second transistors of the first conductivity type is 1:N, wherein a size ratio of the first and second transistors of the second conductivity type is M:1, and wherein M and N are selected such that a multiple of M times N is equal to $(\alpha/(\alpha-1))^{\alpha}$;

a third transistor of the first conductivity type having first and second current terminals coupled between a third supply voltage node and a second output node which provides a second reference voltage, and having a control terminal coupled to a third node;

a third transistor of the second conductivity type having first and second current terminals coupled between the second supply voltage node and the third node, and having a control terminal coupled to the second node; and a second resistive device coupled between the third node and the second output node;

wherein a voltage level of the second reference voltage is determined by a factor K, wherein a size ratio of the third and second transistors of the second conductivity type is KM:1, wherein a size ratio of the third and first transistors of the first conductivity type is K:1, wherein a resistance of the first resistive device is R, and wherein a resistance of the second resistive device is R/K.

13. The voltage reference system of claim 12, wherein the third supply voltage node is an extension of the first supply voltage node.

14. The voltage reference system of claim 12, wherein the first and third supply voltage nodes are independent supply voltage reference nodes.

15. A voltage reference circuit, comprising:

a first transistor of a first conductivity type having first and second current terminals coupled between a first supply voltage node and an output node which provides a reference voltage, and having a control terminal coupled to a first node;

a second transistor of the first conductivity type having first and second current terminals coupled between the first supply voltage node and a second node, and having a control terminal coupled to the output node;

a first transistor of a second conductivity type having first and second current terminals coupled between a second supply voltage node and the first node, and having a control terminal coupled to the second node;

a second transistor of the second conductivity type having first and second current terminals coupled between the second supply voltage node and the second node, and having a control terminal coupled to the second node;

a first resistive device coupled between the first node and the output node; and a third transistor of the first conductivity type having first and second current terminals coupled between the first supply voltage node and a third node and having a control terminal coupled to the output node, wherein the third transistor develops a current that is proportional to absolute temperature;

wherein the first and second transistors of the first conductivity type are governed by an $\alpha$-power-law relationship having a power factor $\alpha$, wherein a size ratio of the first and second transistors of the first conductivity type is 1:N, wherein a size ratio of the first and second transistors of the second conductivity type is M:1, and wherein M and N are selected such that a multiple of M times N is equal to $(\alpha/(\alpha-1))^{\alpha}$.

16. The voltage reference system of claim 15, wherein the first conductivity type is N-type, wherein the second conductivity type is P-type, and wherein the third transistor sinks the current that is proportional to absolute temperature.

17. The voltage reference system of claim 15, wherein the first conductivity type is P-type, wherein the second conductivity type is N-type, and wherein the third transistor sources the current that is proportional to absolute temperature.

18. A voltage reference circuit, comprising:

a first transistor of a first conductivity type having first and second current terminals coupled between a first supply voltage node and an output node which provides a reference voltage, and having a control terminal coupled to a first node;

a second transistor of the first conductivity type having first and second current terminals coupled between the first supply voltage node and a second node, and having a control terminal coupled to the second node;

a first transistor of a second conductivity type having first and second current terminals coupled between a second supply voltage node and the first node, and having a control terminal coupled to a third node;

a second transistor of the second conductivity type having first and second current terminals coupled between the second supply voltage node and a fourth node, and having a control terminal coupled to the third node;

a first resistive device coupled between the first node and the output node and having a resistance R;

a second resistive device coupled between the second node and the fourth node and having a resistance R multiplied by a factor M; and an operational amplifier having a first input coupled to the output node, having a second input coupled to the second node, and having an output coupled to the third node;

wherein the first and second transistors of the first conductivity type are governed by an $\alpha$-power-law relationship having a power factor $\alpha$, wherein a size ratio of the first and second transistors of the first conductivity type is 1:N, wherein a size ratio of the first and second transistors of the second conductivity type is M:1, and wherein M and N are selected such that a multiple of M times N is equal to $(\alpha/(\alpha-1))^{\alpha}$.

19. The voltage reference circuit of claim 18, wherein the first conductivity type is N-type, wherein the second conductivity type is P-type, wherein the first supply voltage node develops a lower supply voltage, and wherein the second supply voltage node develops an upper supply voltage.

20. The voltage reference circuit of claim 18, wherein the first conductivity type is P-type, wherein the second conductivity type is N-type, wherein the first supply voltage node develops an upper supply voltage, and wherein the second supply voltage node develops a lower supply voltage.

* * * * *